US007430795B2

(12) United States Patent
Lin et al.

(10) Patent No.: US 7,430,795 B2
(45) Date of Patent: Oct. 7, 2008

(54) METHOD OF MAKING A SLIDER

(75) Inventors: Joseph Lin, Torrance, CA (US); Ai-Fu Shen, Ningbo (CN)

(73) Assignee: Sport Dimension, Inc., Torrance, CA (US)

( * ) Notice: Subject to any disclaimer, the term of this patent is extended or adjusted under 35 U.S.C. 154(b) by 394 days.

(21) Appl. No.: 11/155,422

(22) Filed: Jun. 17, 2005

(65) Prior Publication Data

US 2006/0286879 A1 Dec. 21, 2006

(51) Int. Cl.
*G11B 5/127* (2006.01)
*H04R 31/00* (2006.01)

(52) U.S. Cl. ..... 29/603.12; 29/603.06; 29/603.2; 29/844; 156/268; 156/344; 156/89.11; 156/89.12; 441/65; 441/74

(58) Field of Classification Search ..... 29/603.06, 29/603.12, 603.2, 844; 156/268, 344, 89.11, 156/89.12, 250; 441/65, 74
See application file for complete search history.

(56) References Cited

U.S. PATENT DOCUMENTS

| | | | | |
|---|---|---|---|---|
| 4,850,913 | A | 7/1989 | Szabad, Jr. | |
| 5,114,370 | A | 5/1992 | Moran | |
| 5,211,593 | A | 5/1993 | Schneider et al. | |
| 5,275,860 | A | 1/1994 | D'Luzansky et al. | |
| 5,876,813 | A | 3/1999 | Bambara et al. | |
| 5,882,776 | A * | 3/1999 | Bambara et al. | 428/215 |
| 2003/0224675 | A1 | 12/2003 | Yeh | |

* cited by examiner

*Primary Examiner*—Paul D Kim
(74) *Attorney, Agent, or Firm*—Raymond Sun

(57) ABSTRACT

A method of making a slider includes the steps of laminating the bottom-facing surface of a third layer to the upper-facing surface of a fourth layer, laminating the bottom-facing surface of a second layer to the upper-facing surface of the third layer in a heat-compression mold, heat-pressing the combined second, third and fourth layers in the mold to form a desired shape, and heat pressing a first layer on top of the second layer inside the mold.

8 Claims, 13 Drawing Sheets

METHOD OF MAKING A SLIDER

BACKGROUND OF THE INVENTION

1. Field of the Invention

The present invention relates to a slider that can be used as a body board, a snow board, a grass sliding board, a sand sliding board, or other board.

2. Description of the Prior Art

Traditional sliders have been used as snow boards, and have increased in popularity as more and more people are seeking snow-related outdoor activities. Examples of such traditional sliders are illustrated in Pub. No. US2003/0224675 (Yeh) and U.S. Pat. No. 4,850,913 (Szabad, Jr.). U.S. Pat. No. 5,275,860 (D'Luzansky et al.) and U.S. Pat. No. 5,114,370 (Moran) illustrate body boards that can be used for water sports.

All of these known sliders and body boards are essentially provided in the form of a simple board having a generally flat upper surface and a generally flat and smooth lower surface. One reason why these sliders have a generally flat and smooth lower surface is because these sliders are typically made by laminating one or more layers of material (e.g., polyethylene) on to a foam core. As a result, it is very difficult and expensive to form a lower surface having a shape and a surface that is anything other than flat and smooth. In addition, the use of this manufacturing method also means that the handles provided for these sliders must be made as separate components and then attached (e.g., with a snap-fit top and bottom handle housing) to the slider.

When these sliders are used as snow boards, the flat and smooth lower surface provides little friction or resistance, so that the user is not able to control or maneuver the slider. As a result, these sliders tend to spin in the snow if an unexpected force is imparted on to any part of the slider. As another result, the user positioned on and moving with the slider is unable to turn or otherwise maneuver the slider.

Therefore, there still remains a need for a slider that overcomes the drawbacks set forth above.

SUMMARY OF THE DISCLOSURE

It is an object of the present invention to provide a slider that allows the user to control and maneuver the slider during use.

It is another object of the present invention to provide a slider that has a traction system provided on its bottom surface for allowing the user to control and maneuver the slider during use.

It is another separate and independent object of the present, invention to provide a slider that has handles built into the slider without using separate handles that must be attached to the slider.

In order to accomplish the objects of the present invention, the present invention provides a method of making a slider having a first upper layer, a second intermediate layer, a third intermediate layer, and a fourth bottom layer. The method includes the steps of laminating the bottom-facing surface of the third layer to the upper-facing surface of the fourth layer, laminating the bottom-facing surface of the second layer to the upper-facing surface of the third layer in a heat-compression mold, heat-pressing the combined second, third and fourth layers in the mold to form a desired shape, and heat pressing the first layer on top of the second layer inside the mold.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
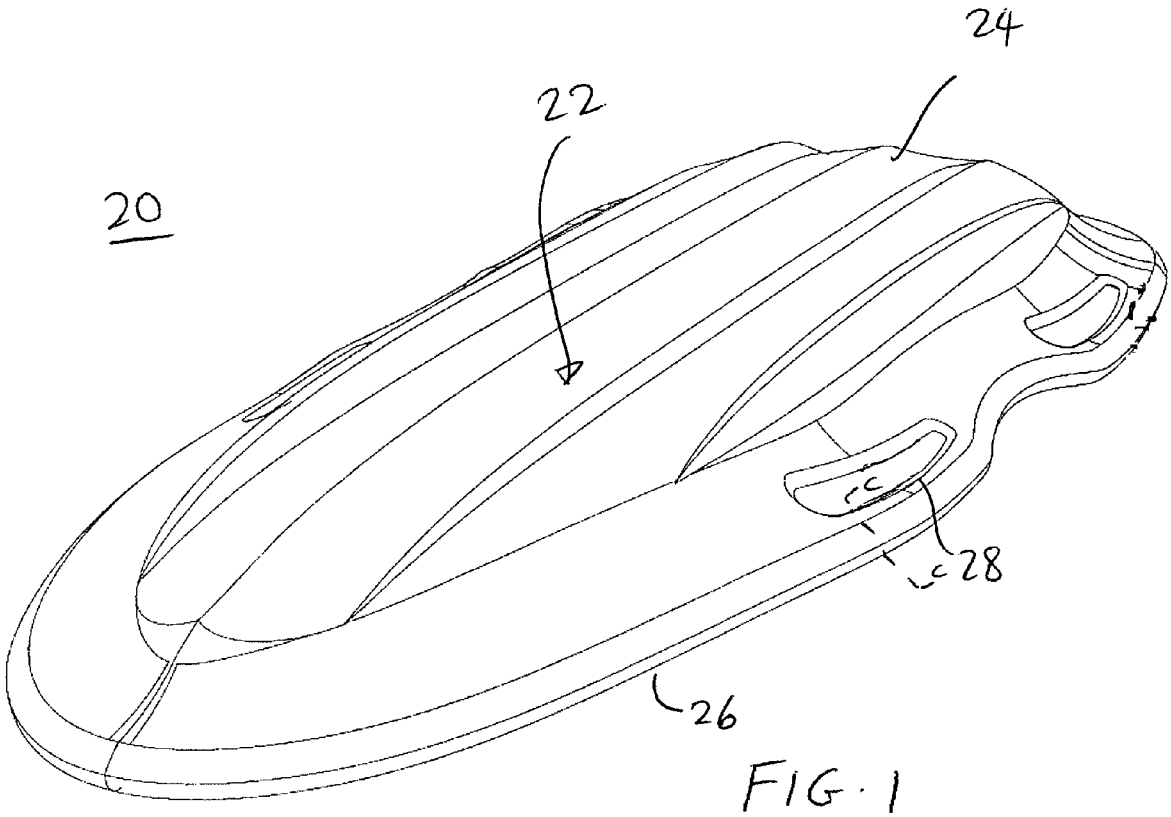
FIG. 1 is a perspective view of a slider according to one embodiment of the present invention.
Figure 2:
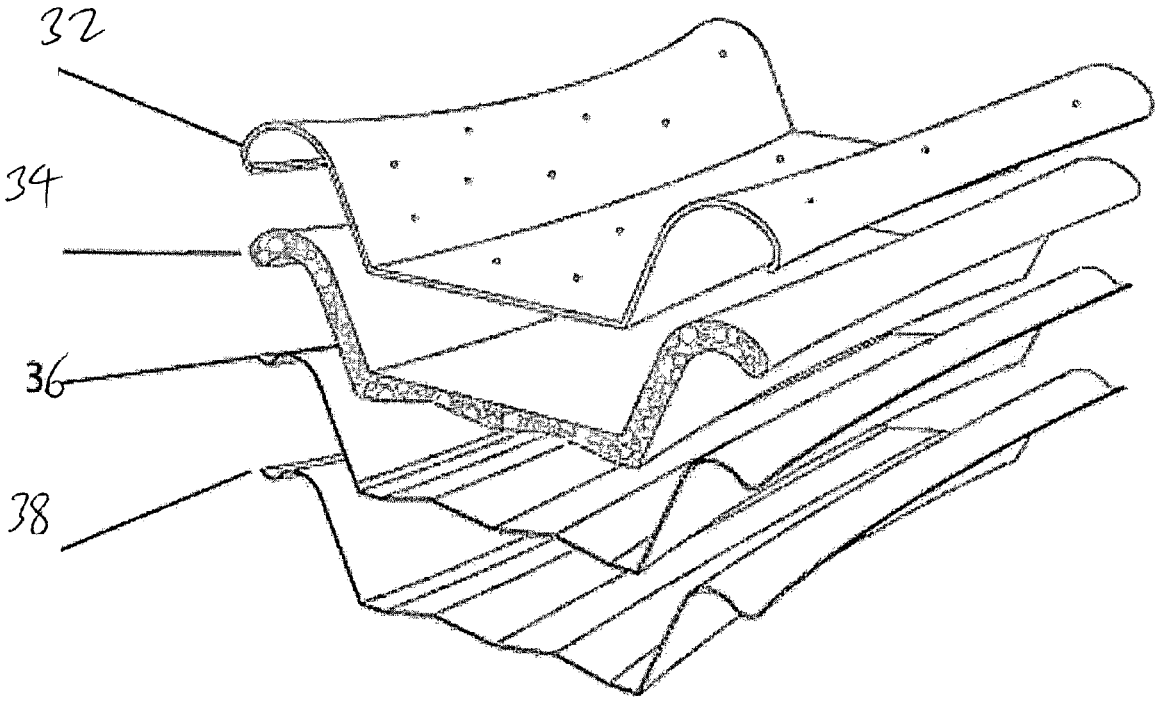
FIG. 2 is a cut-away exploded perspective view illustrating the layers of the slider of FIG. 1 according to one embodiment of the present invention.
Figure 3:
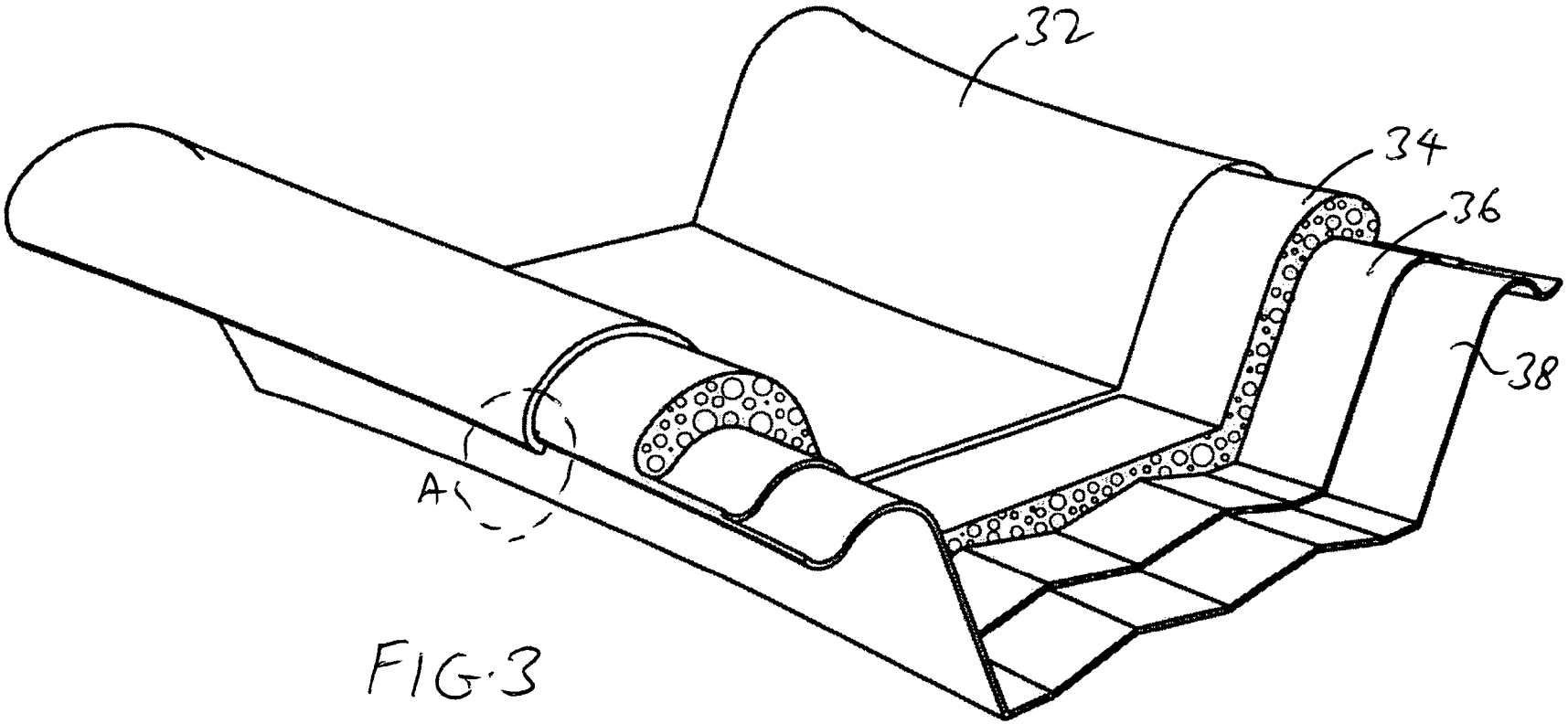
FIG. 3 is a cut-away assembled perspective view of the layers of FIG. 2.

FIG. 1 illustrates a slider 20 which has a board 22 which includes a bottom surface 24 and a top surface 26 (also known as a deck surface). Openings 28 can be provided in the board 22 at any desired location to act as handles. The board 22 can be provided in any shape or size.

FIGS. 2-6 illustrate one embodiment for the board 22. The board 22 can be made up of a first layer 32, a second layer 34, a third layer 36 and a fourth layer 38 that are a laminated together, from top to bottom, in this order. The first layer 32 is preferably a low-density polyethylene (LDPE) or cross-polyethylene (XPE) material having a thickness between 2 mm and 5 mm. The second layer 34 is essentially the core of the board 22, and is preferably a LDPE material having a density between 30 KG to 60 KG per 1 $m^3$. Since the second layer 34 is essentially the core of the board 22, it can have any desired thickness depending on how thick the board 22 is intended to be. The third layer 36 is preferably a LDPE or XPE material having a thickness between 2 mm and 5 mm. The fourth layer 38 is a mixture of a LDPE and a high density polyethylene (HDPE) that has been extruded together. The LDPE can be 30% of the mixture, with the HDPE being 70% of the mixture, or the HDPE can be 30% of the mixture, with the LDPE being 70% of the mixture. Thus, if the mixture includes more HDPE, the fourth layer 38 will be made of a harder material than if the mixture includes more LDPE.

As non-limiting examples, a HDPE material according to the present invention would have a specific gravity of less than 0.94, while a LDPE material according to the present invention would have a specific gravity of 0.94 or more.

The density of the material of the first layer 32 is preferably greater than the density of the material for the second layer 34, and can have the same or greater density than the material for the third layer 36. The density of the material of the third layer 36 is preferably greater than the density of the material for the second layer 34. In other words, the density of the material for the second layer 34 is the smallest because the second layer 34 acts as the core. In addition, the density of the material for the fourth layer 38 is greater than the densities of the materials for the other layers 32, 34, 36 because the fourth layer 38 represents the bottom of the board 22 and therefore needs to be stronger.

The board 22 can be formed according to the following process:

1. The fourth layer 38 is formed by a liquid extrusion process.

2. The bottom-facing surface of the third layer 36 is heat laminated to the upper-facing surface of the fourth layer 38. This can be accomplished by applying (e.g., sticking) the third layer 36 to the fourth layer 38 while the fourth layer 38 is still wet from its liquid extrusion, and then allowing the layers 36 and 38 to dry and bond together.

3. The combined third and fourth layers 36 and 38 are then heat laminated with the second layer 34 in a heat compression mold. Specifically, the bottom-facing surface of the second layer 34 is heat laminated to the upper-facing surface of the third layer 36. The mold is formed in any desired shape, and is therefore used to shape the board 22.

4. The layers 34, 36 and 38 are heat-pressed in the mold to form the desired product shape.

5. The mold is then opened, and the first layer 32 is placed into the mold and heat-pressed on top of the upper-facing layer of the second layer 34.

6. The mold is opened and excess material is trimmed away from the edges in the manner illustrated in FIGS. 4A and 4B.

Figure 4B:
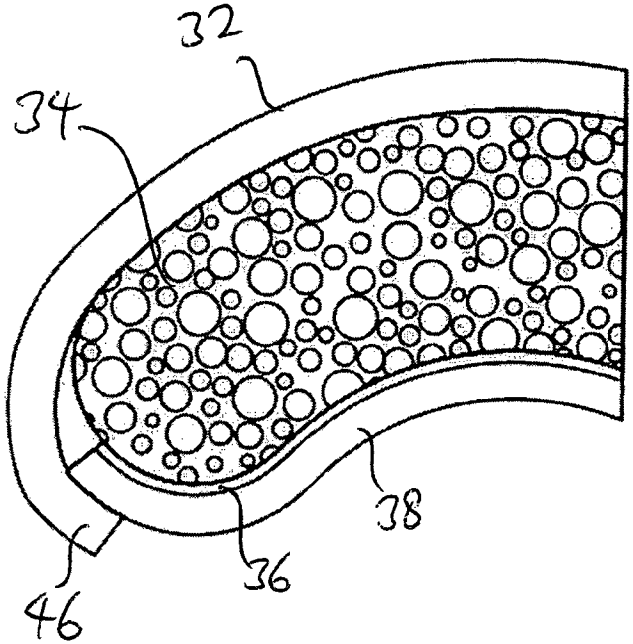
FIGS. 4A and 4B are enlarged cross-sectional views of the section A of FIG. 3.
Figure 4A:
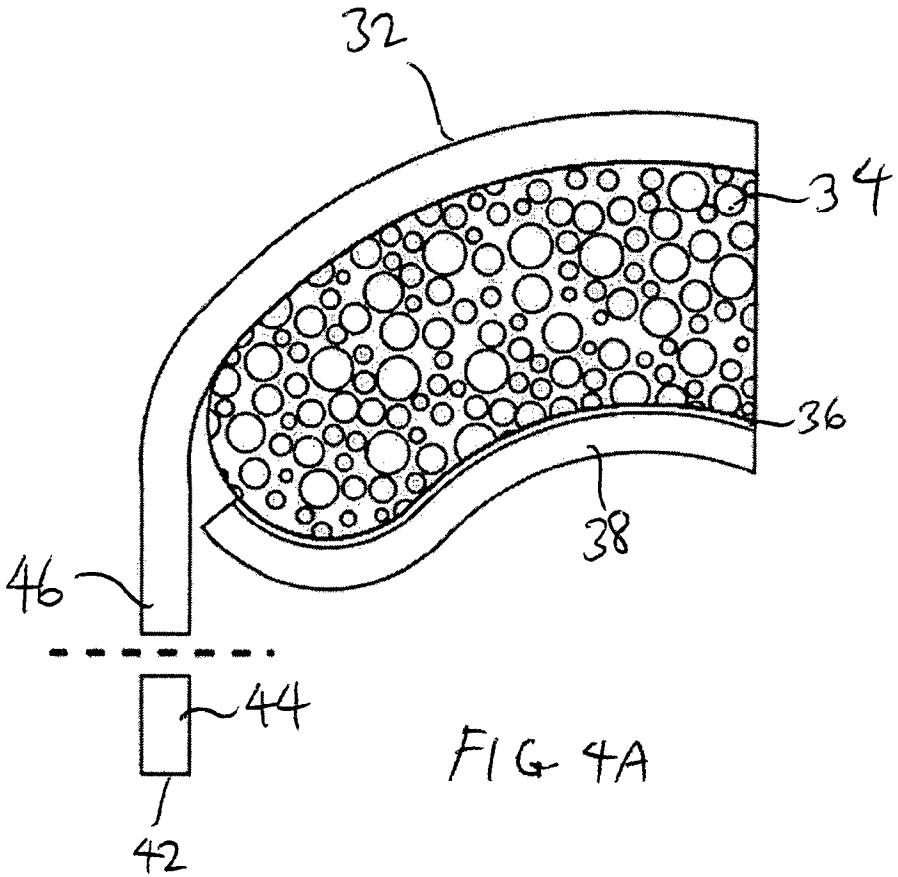

As shown in FIG. 4A, a portion 44 of the edge 42 of the first layer 32 may not be laminated to the second layer 34 because of the curvature of the other layers 34, 36 and 38. This portion 44 is therefore an excess portion that can be manually cut (e.g., by a blade), or cut by a machine that has a blade. The resulting edge 46 of the first layer 32 is then heat sealed to the fourth layer 38, as shown in FIG. 4B.

Figure 4C:
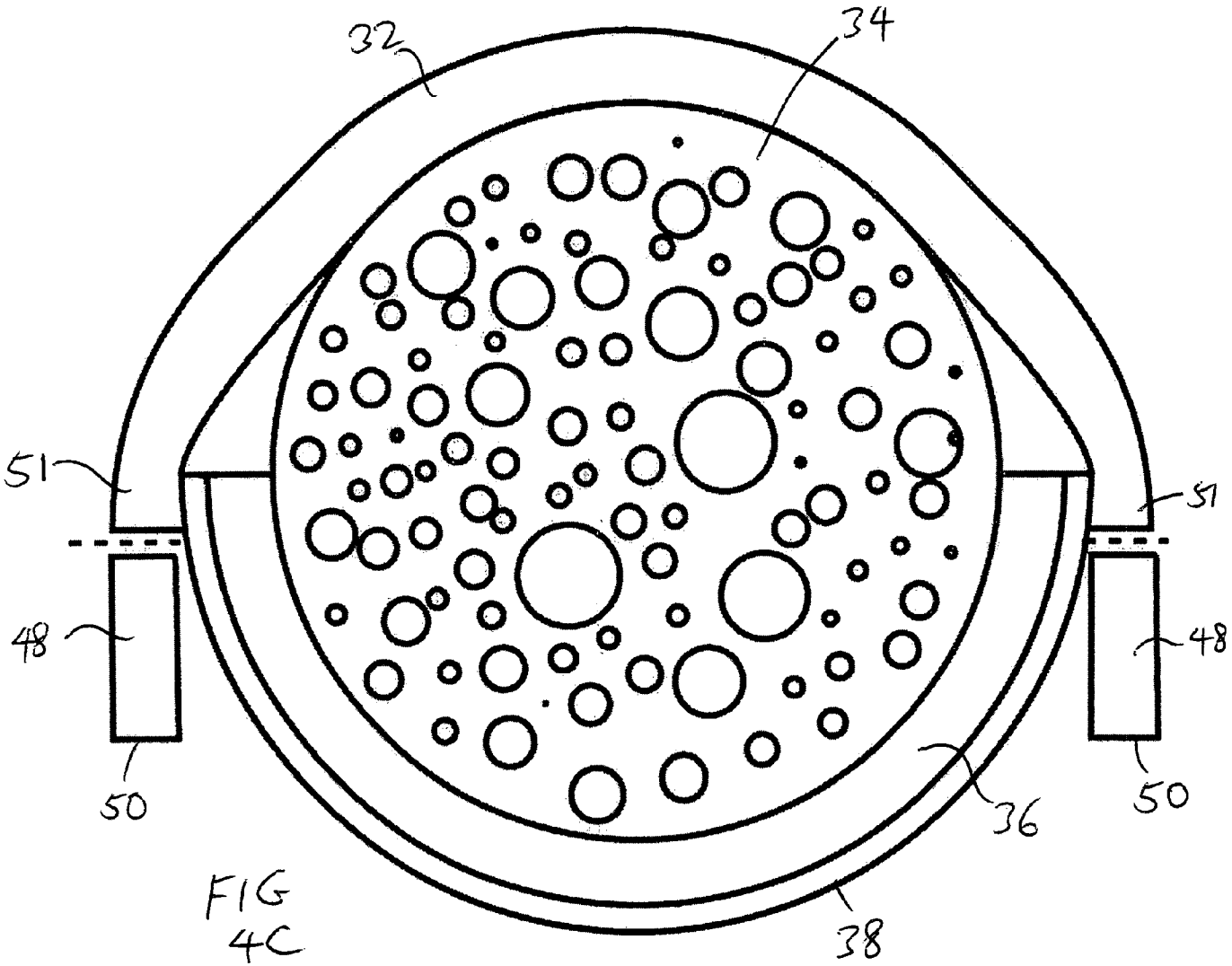
FIG. 4C is a cross-sectional view taken along line C-C in FIG. 1.
Figure 6:
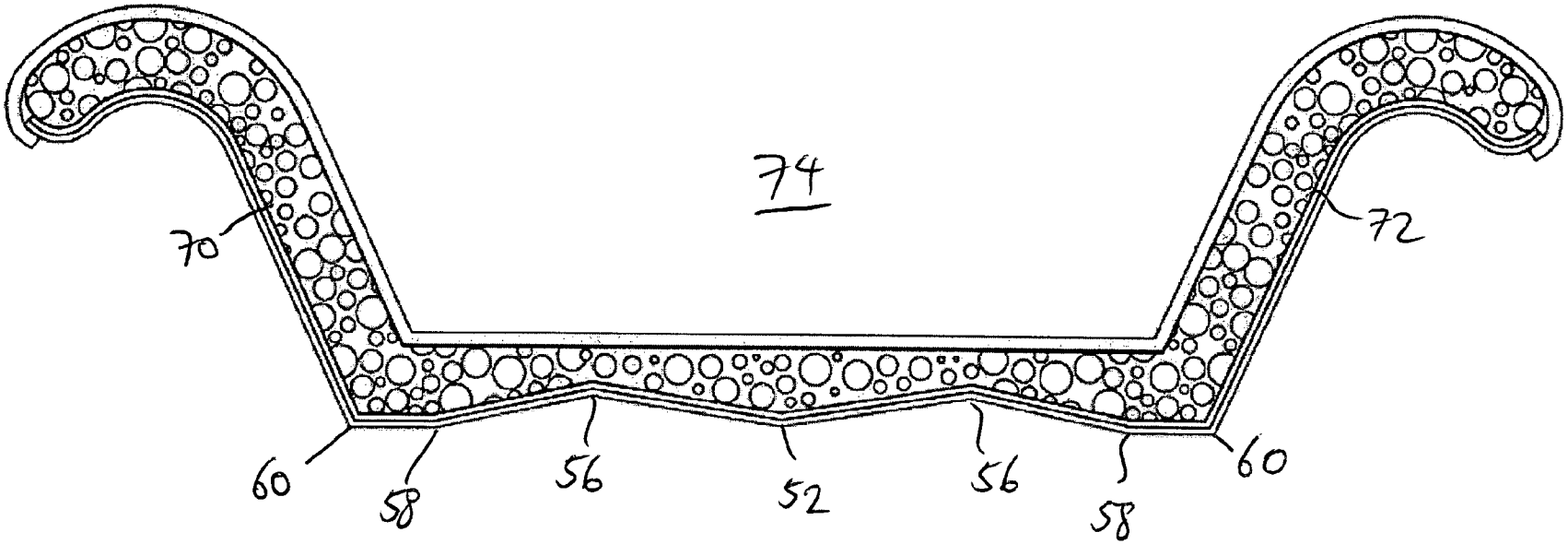
FIG. 6 is a cross-sectional view of the traction system of FIG. 5 taken along line 6-6.

The molding of the layers 34+36+38 to the first layer 32 allows the board 22 to be formed with any desired cross-sectional shape. For example, as shown in FIG. 6, the board 22 can be formed to have (i) two side walls 70 and 72 that enclose an interior space 74, and (ii) a traction system as described below. In addition, the molding of the layers 34+36+38 to the first layer 32 allows the board 22 to be formed with openings 28 that can be used as handles by a user for gripping purposes. To form handles, the edges of the first layer 32 can be processed in the same manner as shown in FIGS. 4A and 4B. Specifically, as shown in FIG. 4C, a portion 48 of the edge 50 of the first layer 32 may not be laminated to the second layer 34 because of the curvature of the other layers 34, 36 and 38. This portion 48 is therefore an excess portion that can be manually cut (e.g., by a blade), or cut by a machine that has a blade. The resulting edge 51 of the first layer 32 is then heat sealed to the fourth layer 38. This can be done on both sides of each opening 28.

Figure 5:
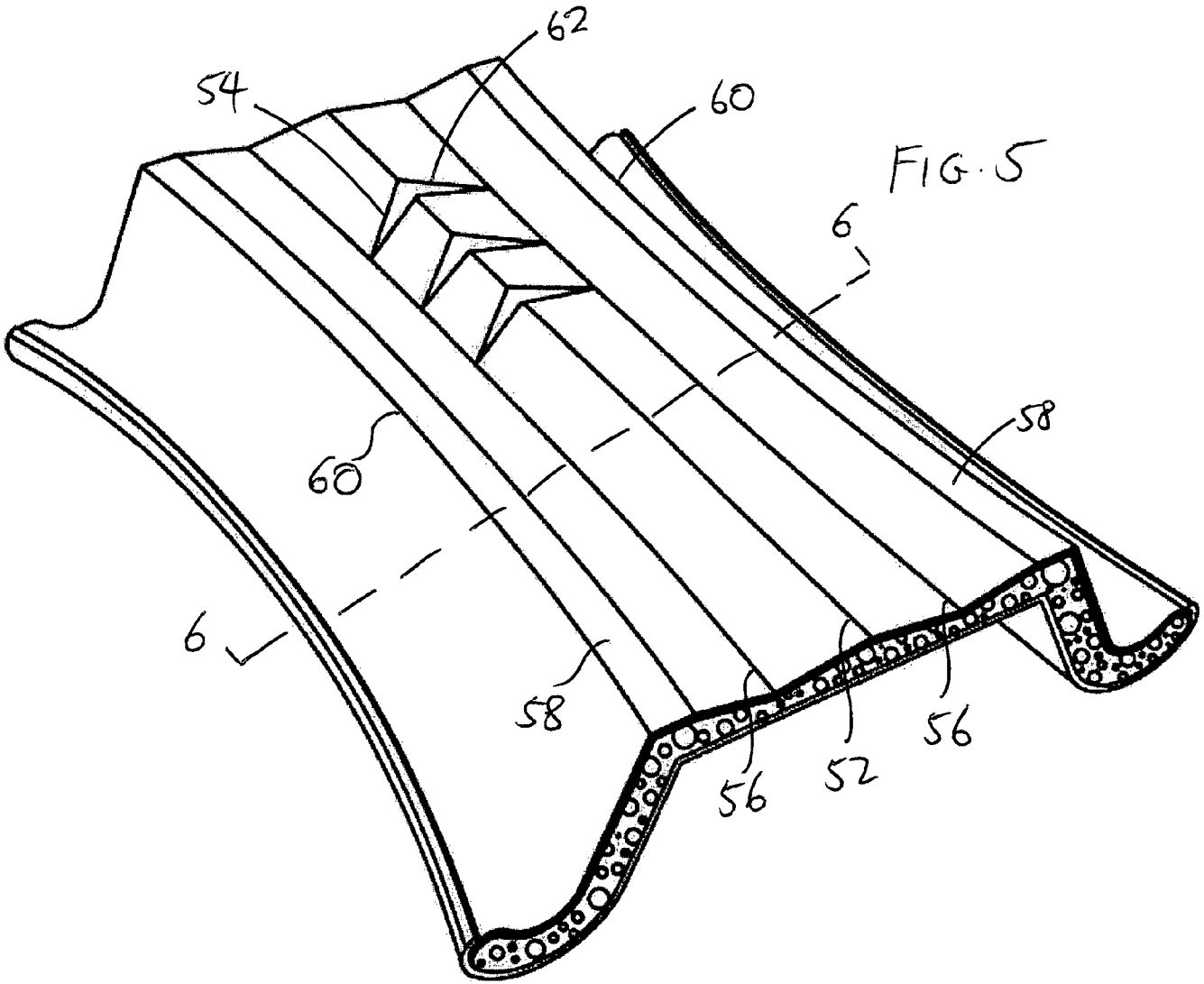
FIG. 5 is a bottom perspective view of the traction system of the slider of FIG. 1.

A traction system can be provided on the bottom of the board 22 to allow the user to control and maneuver the slider during use. Referring to FIGS. 5 and 6, the traction system can include a generally V-shaped central tracking edge 52 for speed and directional control, a braking system 54 that is provided with the central track system 52 for stopping the slider 20, a recessed straight edge 56 provided on either side of the central tracking edge 52 for gripping the snow, a straight edge 58 exterior to each recessed straight edge 56 for speed and directional control, and a parabolic edge 60 positioned exterior to each straight edge 58 to assist in turning of the slider 20. The edges 52 and 58 are raised areas on the board 22 that are capable of digging into the snow when the board 22 is in use. The raised areas mean that there is minimal surface area in contact with the snow (similar to an aerofoil boat concept), thereby creating less drag to facilitate higher speeds. In addition, the narrowness of the raised areas provides good directional control in the same manner that a surfboard fin accomplishes this function. The recessed straight edges 56 are two channels which fill with snow when the board 22 travels downhill, thereby helping the board 22 to maintain direction and improve grip. The parabolic edge 60 has a curvature which allows the board 22 to turn in the direction of the curvature. All of these edges 52, 56, 58 and 60, and the braking system 54, are pre-formed in the mold, so that the board 22 and its bottom surface 24 can be formed by the mold with these edges 52, 56, 58 and 60, and the braking system 54 incorporated therein. The braking system 54 is formed by a plurality of cut-outs 62 in the V-shaped central tracking edge 52. These cut-outs 62 fill with snow when the board 22 turns backwards, thereby slowing the board 22 to fulfill the braking function.

Figure 7:
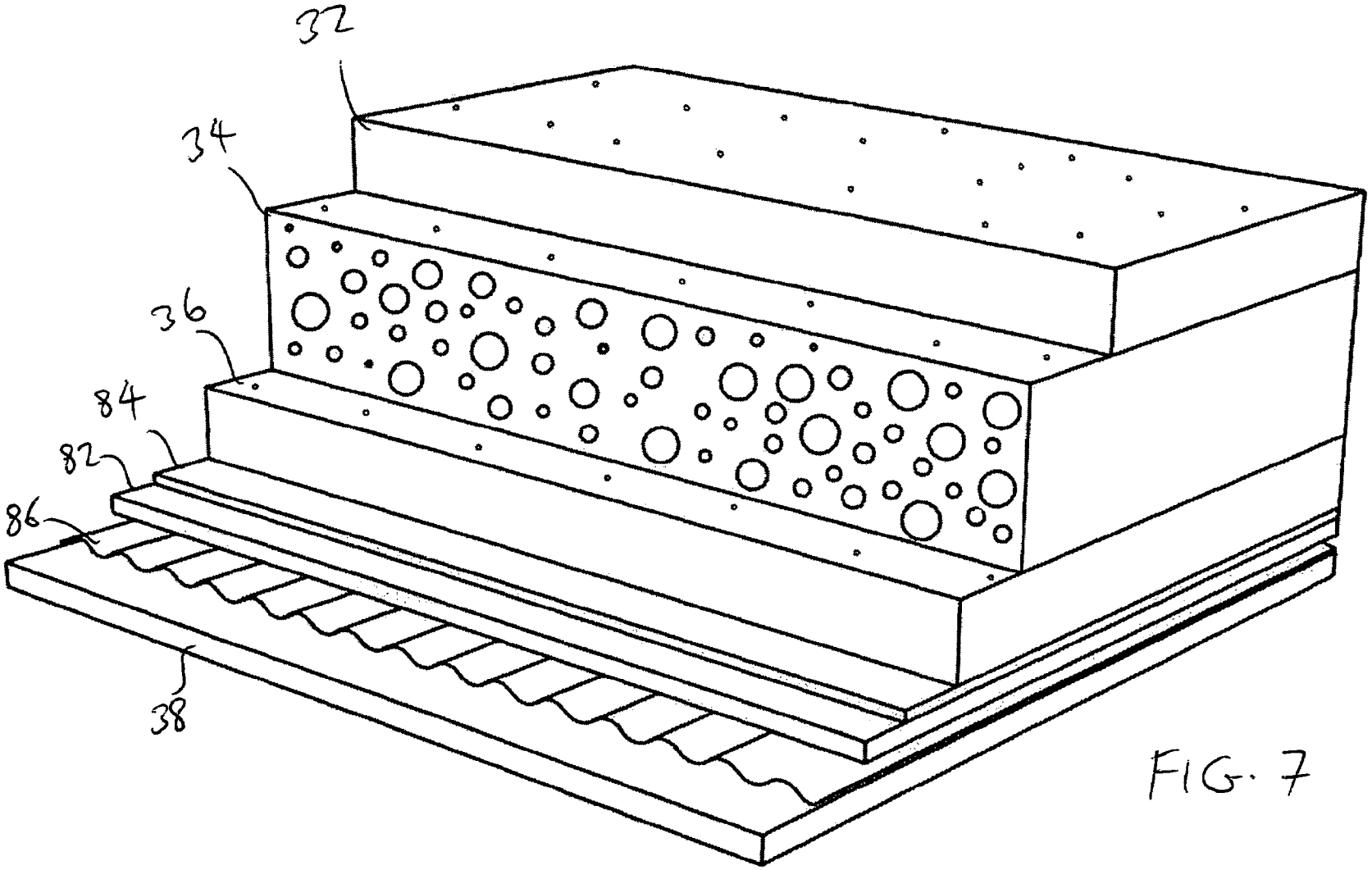
FIG. 7 is a perspective cross-sectional view of a slider according to another embodiment of the present invention where graphics are incorporated on the bottom surface thereof.

The embodiment shown and illustrated in FIGS. 1-6 is of a slider 20 that does not have any graphics or patterns printed on the bottom surface 24 or the top surface 26. FIG. 7 illustrates how graphics can be provided on the bottom surface 24 of the slider 20 according to one embodiment of the present invention. A printing layer 82 and a binding layer 84 can be provided between the third layer 36 and the fourth layer 38. The process for forming the slider shown in FIG. 7 is as follows.

7*a*. A graphics pattern 86 can be formed (e.g., by printing) on the bottom-facing surface of the printing layer 82. The graphics pattern 86 can be ink that is printed to the bottom-facing surface of the printing layer 82 using techniques known in the art, and represents the desired graphics. The printing layer 82 can be embodied in the form of a LDPE material having a thickness ranging from 0.04 mm to 0.08 mm.

7*b*. The upper-facing surface of the printing layer 82 is heat laminated to the bottom-facing surface of the binding layer 84. The binding layer 84 can be embodied in the form of a PE or LDPE material having a thickness ranging from 0.02 mm to 0.04 mm.

7*c*. The upper-facing surface of the binding layer 84 of the combined printing layer 82 and binding layer 84 (with the graphics pattern 86 printed on the bottom facing surface of the printing layer 82) is heat laminated to the bottom-facing surface of the third layer 36.

7*d*. The bottom-facing surface of the printing layer 82 (i.e., the surface on which the graphics pattern 86 is printed) is heat laminated to the upper-facing surface of the fourth layer 38.

7*e*. The process then follows the same steps as steps 3-6 set forth above in connection with the embodiment of FIGS. 1-6, with the binding layer 84 and the printing layer 82 sandwiched between the third and fourth layers 36 and 38.

Figure 8:
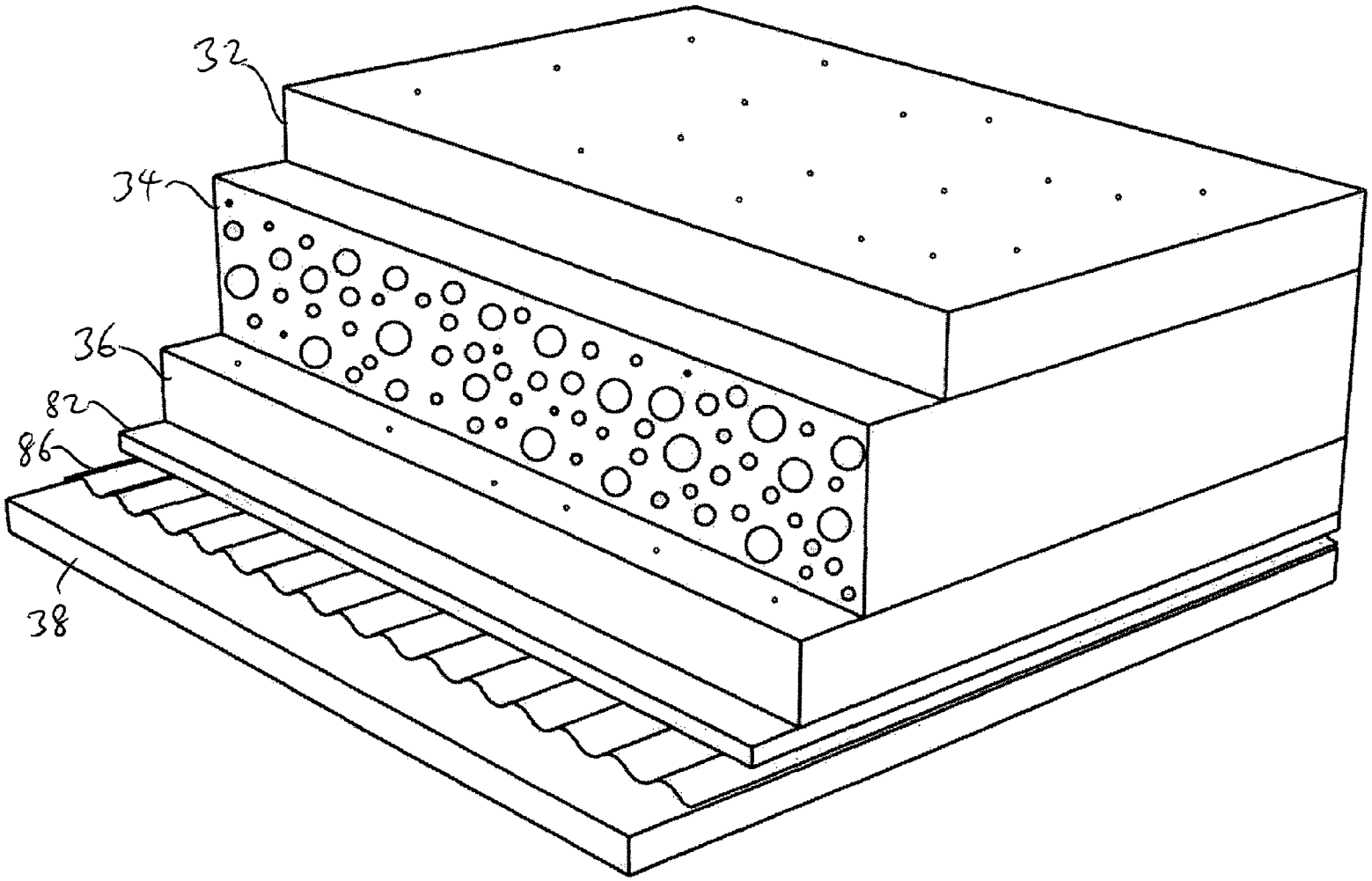
FIG. 8 is a perspective cross-sectional view of the slider of FIG. 7 illustrating modifications made thereto.

FIG. 8 illustrates a modification that can be made to the slider of FIG. 7, where the binding layer 84 is omitted. The binding layer is not essential, and functions to strengthen the bonding between the layers 82 and 36. Thus, where it is desired to reduce manufacturing costs, the binding layer 84 can be omitted. The process for making the slider of FIG. 8 is the same as described above for the slider of FIG. 7, except that the upper-facing surface of the printing layer 82 is directly heat-laminated to the bottom-facing surface of the third layer 36.

Figure 9:
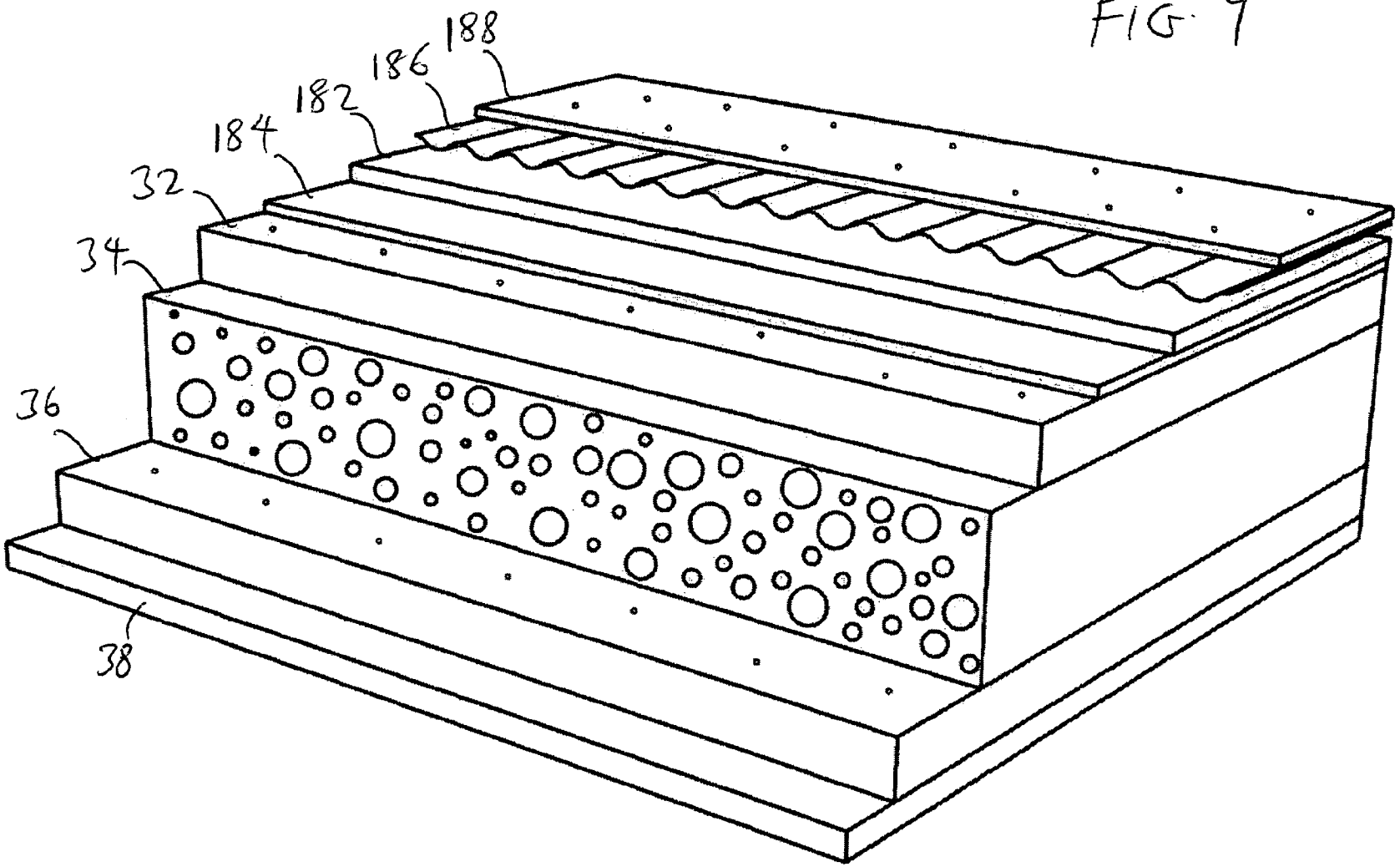
FIG. 9 is a perspective cross-sectional view of a slider according to another embodiment of the present invention where graphics are incorporated on the top surface thereof.

FIG. 9 illustrates how graphics can be provided to the top surface 26 of the slider 20 according to one embodiment of the present invention. A printing layer 182, a binding layer 184 and a protection layer 188 can be provided above the first layer 32. The process for forming the slider shown in FIG. 9 is as follows.

9*a*. A graphics pattern 186 can be formed (e.g., by printing) on the upper-facing surface of the printing layer 182. The graphics pattern 186 can be ink that is printed to the upper-facing surface of the printing layer 182 using techniques known in the art, and represents the desired graphics. The printing layer 182 and the binding layer 184 can be identical to the printing layer 82 and the binding layer 84 described above in connection with the slider of FIG. 7.

9*b*. The protection layer 188 is heat laminated to the upper-facing surface of the printing layer 182 (i.e., the surface on which the graphics pattern 186 is printed). The protection layer 188 can be embodied in the form of a transparent polyethylene layer having a thickness ranging from 0.02 mm to 0.05 mm.

9*c*. The bottom-facing surface of the printing layer 182 of the combined protection layer 188 and printing layer 182 is positioned above the upper-facing surface of the binding layer 184, and the bottom-facing surface of the binding layer 184 is positioned above the upper-facing surface of the first layer 32, and these layers 188+182+184+32 are simultaneously heat laminated together.

9*d*. The process then follows the same steps as steps 1-6 set forth above in connection with the embodiment of FIGS. 1-6, with the protection layer 188, the binding layer 184 and the printing layer 182 laminated to the top of the first layer 32. Specifically, in step 5 of the embodiment of FIGS. 1-6, when the mold is opened, the combined layers 188, 184, 182 and 32 are placed into the mold and heat-pressed on top of the upper-facing layer of the second layer 34.

Figure 10:
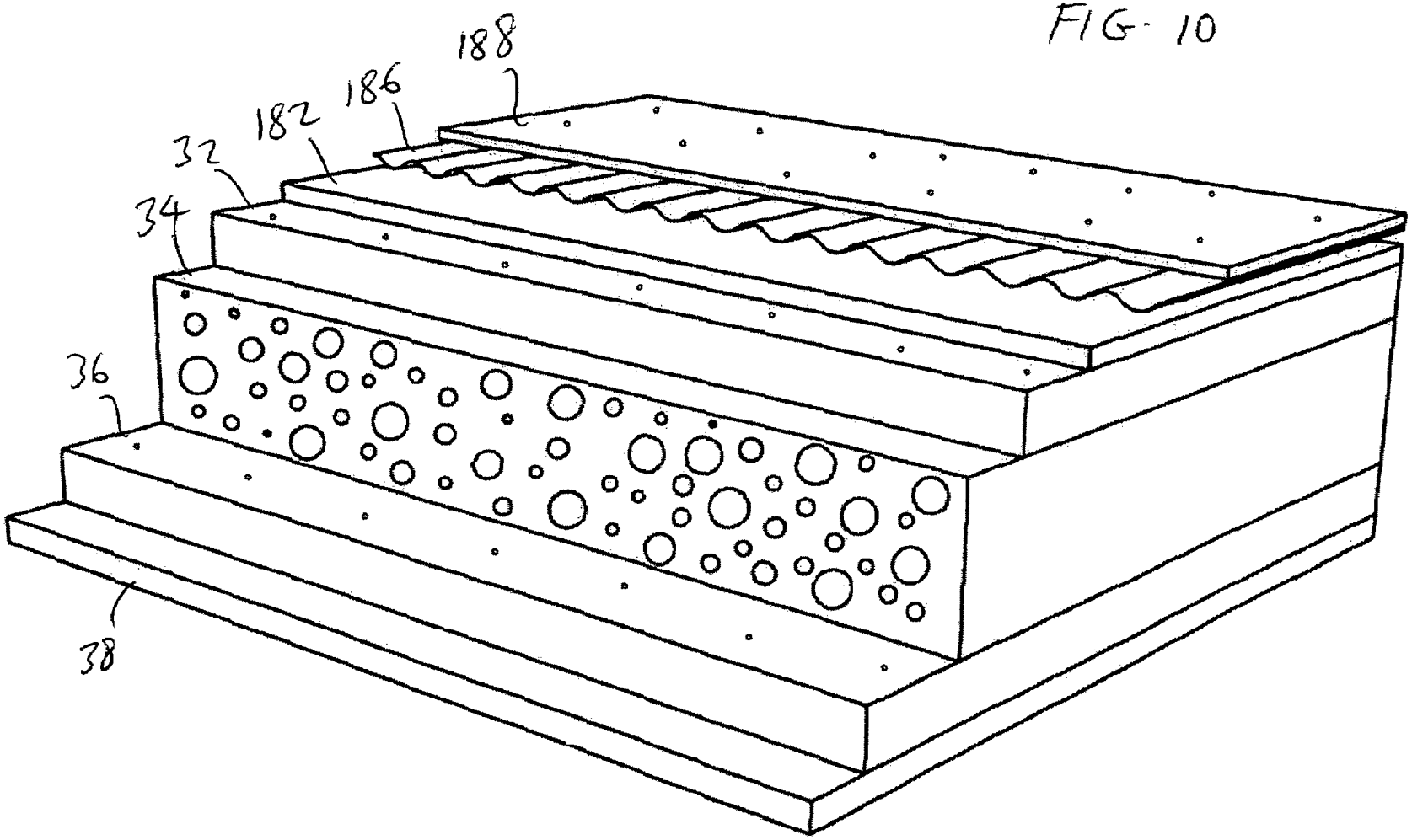
FIG. 10 is a perspective cross-sectional view of the slider of FIG. 9 illustrating modifications made thereto.

FIG. 10 illustrates a modification that can be made to the slider of FIG. 9, where the binding layer 184 is again omitted. The process for making the slider of FIG. 10 is the same as described above for the slider of FIG. 9, except that the bottom-facing surface of the printing layer 182 is directly heat-laminated to the upper-facing surface of the first layer 32.

Figure 11:
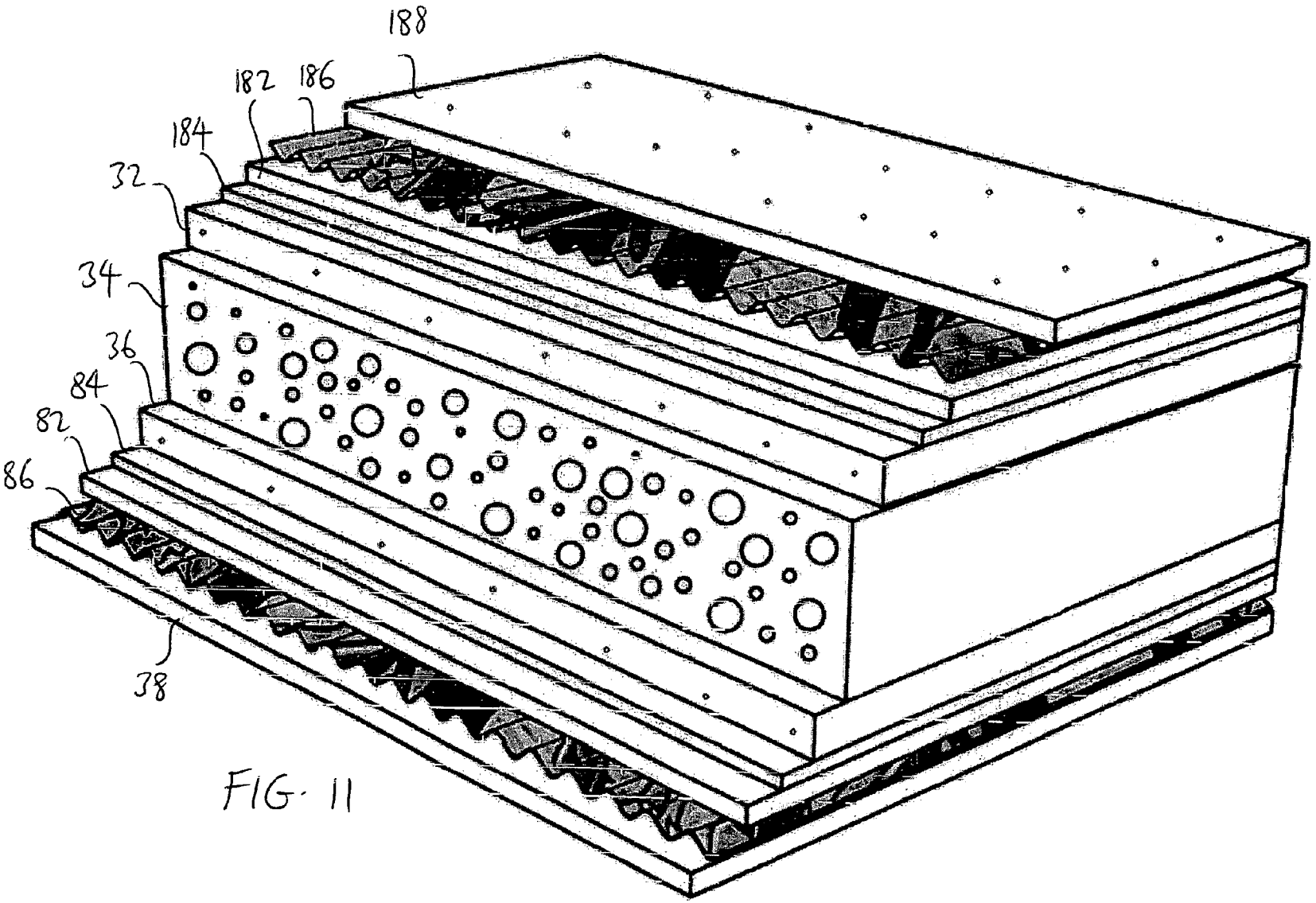
FIG. 11 is a perspective cross-sectional view of a slider according to another embodiment of the present invention where graphics are incorporated on the top and bottom surfaces thereof.

The construction and processes illustrated in connection with FIGS. 7-10 can be combined to provide graphics on both the bottom surface 24 and the top surface 26 of the slider 20. For example, FIG. 11 illustrates the layers for a slider that incorporates the principles illustrated in FIGS. 7 and 9. The same numeral designations utilized in the embodiments in FIGS. 7 and 9 are also used in FIG. 11, since the same layers are present in the slider of FIG. 11. The process for forming the slider shown in FIG. 11 is essentially a combination of the processes for the embodiments of FIGS. 7 and 9, and includes the following steps (in one possible order):

11*a*. Follow steps 7*a*-7*d* for the embodiment of FIG. 7 to obtain combined layers 36, 84, 82 and 38.

11*b*. Follow steps 9*a*-9*c* for the embodiment of FIG. 9 to obtain combined layers 188, 182, 184 and 32.

11*c*. The combined layers 36, 84, 82 and 38 (from step 11*a* above) are then heat laminated with the second layer 34 in a heat compression mold. In other words, the bottom-facing surface of the second layer 34 is heat laminated to the upper-facing surface of the third layer 36.

11*d*. The combined layers 34, 36, 84, 82 and 38 are heat-pressed in the mold to form the desired product shape.

11*e*. The mold is then opened, and the combined layers 188, 182, 184 and 32 (from step 11*b*) are placed into the mold and heat-pressed on top of the upper-facing layer of the second layer 34.

11*f*. The mold is opened and excess material is trimmed away from the edges in the manner illustrated in FIGS. 4A and 4B.

Figure 12:
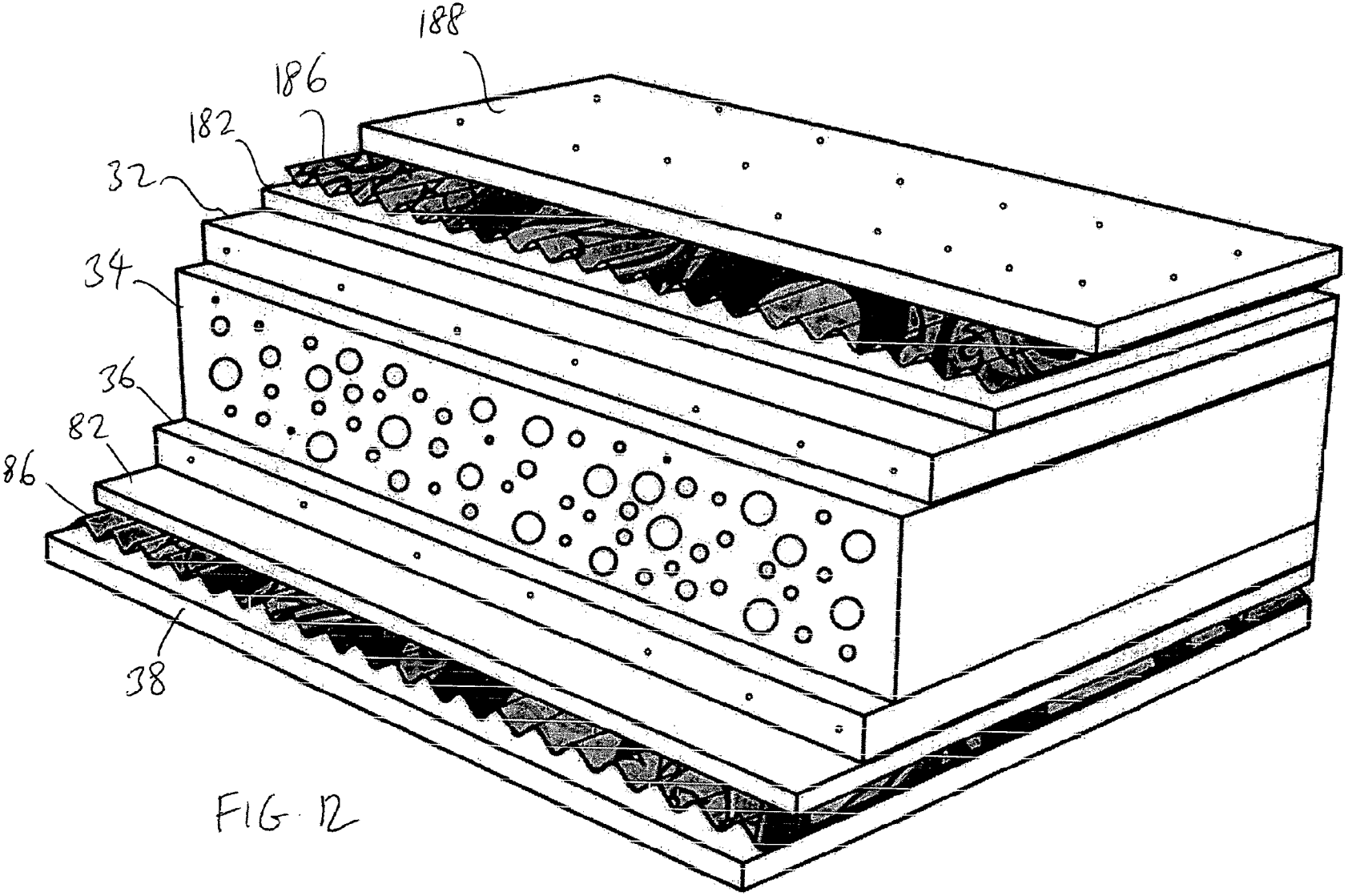
FIG. 12 is a perspective cross-sectional view of the slider of FIG. 11 illustrating modifications made thereto.

FIG. 12 illustrates a modification that can be made to the slider of FIG. 11, where the binding layers 84 and 184 are again omitted. The process for making the slider of FIG. 12 is the same as described above for the slider of FIG. 11, except that the bottom-facing surface of the printing layer 182 is directly heat-laminated to the upper-facing surface of the first layer 32, and the upper-facing surface of the printing layer 82 is directly heat-laminated to the bottom-facing surface of the third layer 36.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A method of making a slider having an upper protection layer, an upper printing layer, a first upper layer, a second intermediate layer, a third intermediate layer, a lower printing layer, and a fourth bottom layer, comprising:

a. printing a graphics pattern on a bottom-facing surface of the lower printing layer;

b. attaching an upper-facing surface of the lower printing layer to a bottom-facing surface of the third layer;

c. laminating the bottom-facing surface of the lower printing layer to an upper-facing surface of the fourth layer;

d. laminating a bottom-facing surface of the second layer to an upper-facing surface of the third layer in a heat-compression mold;

e. forming a graphics pattern on an upper-facing surface of the upper printing layer;

f. laminating the protection layer to the upper-facing surface of the upper printing layer;

g. attaching a bottom-facing surface of the upper printing layer to an upper-facing surface of the first layer;

h. heat-pressing the combined second, third, lower printing layer and fourth layers in a mold to form a desired shape; and then i. heat pressing the combined protection layer, upper printing layer and first layer on top of the second layer inside the mold to form the slider.

2. The method of claim 1, further including:

forming the fourth layer by a liquid extrusion process.

3. The method of claim 1, further including:

forming the fourth layer with a mixture of a low density polyethylene and a high density polyethylene.

4. The method of claim 1, further including:

trimming excess material from the edges of the slider.

5. The method of claim 1, further including:

providing the second layer with the lowest density; and providing the fourth layer with the highest density.

6. The method of claim 5, further including:

providing the first layer with a density that is greater than the density of the third layer; and providing the third layer with a density that is greater than the density of the second layer.

7. The method of claim 5, further including:

providing the second layer with a density between 30 KG to 60 KG per 1 $m^3$.

8. The method of claim 1, further including:

forming an opening that extends through the first, second, third and fourth layers.

* * * * *